US005879177A

United States Patent [19]

Honma

[11] Patent Number: 5,879,177

[45] Date of Patent: Mar. 9, 1999

[54] ADAPTER FOR CONNECTION OF COAXIAL CONNECTORS AND CONNECTION STRUCTURE FOR COAXIAL CONNECTORS

[75] Inventor: Tomoyuki Honma, Tokyo, Japan

[73] Assignee: NEC Corporation, Tokyo, Japan

[21] Appl. No.: 785,022

[22] Filed: Jan. 17, 1997

[30] Foreign Application Priority Data

Jan. 24, 1996 [JP] Japan ..... 8-009919

[51] Int. Cl.[6] ..... H01R 13/629

[52] U.S. Cl. ..... 439/246; 439/578; 439/675; 439/654

[58] Field of Search ..... 439/246, 252, 439/247, 248, 638, 675, 578, 654

[56] References Cited

U.S. PATENT DOCUMENTS

| | | | |
|---|---|---|---|
| 2,644,028 | 6/1953 | Bernet | 439/578 |
| 2,954,542 | 9/1960 | Wales | 439/252 |
| 3,056,940 | 10/1962 | Winestock | 439/252 |
| 4,925,403 | 5/1990 | Zorzy | 439/578 |
| 5,329,262 | 7/1994 | Fisher, Jr. | 439/248 |
| 5,667,409 | 9/1997 | Wong et al. | 439/675 |

FOREIGN PATENT DOCUMENTS

| | | | |
|---|---|---|---|
| 25937 | 8/1970 | Japan | 439/246 |
| 57-205978 | 12/1982 | Japan . | |
| 3-6681 | 1/1991 | Japan . | |

*Primary Examiner*—Paula Bradley
*Assistant Examiner*—Tho D. Ta
*Attorney, Agent, or Firm*—Foley & Lardner

[57] ABSTRACT

A coaxial connector adaptor for connecting at least a pair of coaxial connections disposed in an opposing relationship to each other and displaceable in a direction perpendicular to the opposing direction thereof, includes an outer conductor connection terminal whose opposite end portions slidably contact for angular displacement with outer conductors of the opposing coaxial connectors, and a central conductor connection terminal whose opposite end portions slidably contact for angular displacement with central conductors of the opposing coaxial connectors.

15 Claims, 7 Drawing Sheets

ADAPTER FOR CONNECTION OF COAXIAL CONNECTORS AND CONNECTION STRUCTURE FOR COAXIAL CONNECTORS

BACKGROUND OF THE INVENTION

1. Field of the Invention

This invention relates to a connection structure for coaxial connectors wherein the relative positions of opposing coaxial connectors are displaceable in a direction perpendicular to the opposing direction, and particularly to an adapter for use in connecting such coaxial connectors.

2. Description of the Related Art

Conventionally, as a connection structure for coaxial connectors, a connection structure for a coaxial connector and an electronic circuit unit is disclosed in Japanese Patent Laid-Open Application No. Showa 57-205978 wherein a male connection screw is attached to a housing of a coaxial connector having a central conductor while a case of an electronic circuit unit to be connected to the coaxial connector includes a female screw with which the connection screw is to be screwed, and a coaxial terminal having a central conductor to be coupled to the coaxial connector concentrically with the female screw. Meanwhile, Japanese Patent Publication Application No. Heisei 3-6681 discloses another connection structure for coaxial connectors wherein at least one of a plug side central conductor and a jack side central conductor is supported by a cantilever support structure having a free end on the fitting side thereof and a gap is provided between an outer periphery of a fitting portion of a plug side outer conductor and an inner periphery of a fitting portion of a jack side outer conductor. Those connection structures for coaxial connectors connect coaxial lines to each other in a small space.

By the way, for connection of a transmitter-receiver board to a communication apparatus, a structure shown in FIG. 1 is known. Referring to FIG. 1, a transmitter-receiver 120 including a case in which a transmitter-receiver circuit formed as a unit is accommodated is secured to a transmitter-receiver board 110. The transmitter-receiver 120 includes a plurality of coaxial connectors 140 provided thereon for connecting a communication apparatus (not shown) and the transmitter-receiver 120 to each other when the transmitter-receiver board 110 is mounted on the communication apparatus.

The position of the coaxial connector on the communication apparatus side with respect to the mounted position of the transmitter-receiver board 110 depends upon the type of the communication apparatus. Therefore, in order to provide the transmitter-receiver board 110 with universality, a coaxial connector housing 130 having a plurality of coaxial connectors 150 to be connected individually to the coaxial connectors 140 of the transmitter-receiver 120 with coaxial cables 160 interposed therebetween is provided on the transmitter-receiver board 110 so that the position thereof can be adjusted in the direction indicated by an arrow A. The coaxial connectors 150 of the coaxial connector housing 130 are connected to the coaxial connector of the communication apparatus.

Since the coaxial cables 160 are used for connection of the coaxial connectors 140 of the conventional transmitter-receiver board 110 described above, in order to allow adjustment of the position of the coaxial connector housing 130, the coaxial cables 160 must have a sufficient length to allow the coaxial cables 160 to be connected in individually curved conditions. However, the lowest value of the radius of curvature of the coaxial cables 160 is limited by the rigidity of the coaxial cables 160. Therefore, some space is required between the coaxial connector housing 130 and the transmitter-receiver 120, and this presents an obstacle to miniaturization of the transmitter-receiver board.

A possible countermeasure to solve this is to apply the structure disclosed in Japanese Patent Laid-Open Application No. Showa 57-205978 or Japanese Patent Publication Application No. Heisei 3-6681. However, since the structure disclosed in Japanese Patent Laid-Open Application No. Showa 57-205978 relates to a connection between a coaxial cable and an electronic circuit unit, one cannot still avoid to employing a coaxial cable for connection between the coaxial connectors, and therefore the structure does not provide a fundamental solution. Meanwhile, with the structure disclosed in Japanese Patent Publication Application No. Heisei 3-6681, even if the opposing positions of two coaxial connectors are displaced relative to each other, the central conductor supported in the form of a cantilever is distorted in a radial direction so that the two coaxial connectors can be connected to each other without a coaxial cable interposed therebetween. However, since the displacement between the opposing positions of the coaxial connectors is absorbed making use of the distortion of the central conductor in this manner, the allowable amount of displacement is approximately several tenth mm. Accordingly, the structure cannot absorb a large amount of displacement.

SUMMARY OF THE INVENTION

It is an object of the present invention to provide an adapter and a connection structure by which coaxial connectors whose relative positions are adjustable in a direction perpendicular to their respective opposing directions can be connected in a minimum space without using a coaxial cable.

In order to attain the object described above, according to an aspect of the present invention, there is provided an adapter for connecting at least a pair of coaxial cables disposed in an opposing relationship to each other and displaceable in a direction perpendicular to the opposing direction thereof, comprising:

an outer conductor connection terminal whose opposite end portions slidably contact for angular displacement with outer conductors of the opposing coaxial connectors; and a central conductor connection terminal whose opposite end portions slidably contact for angular displacement with central conductors of the opposing coaxial connectors.

According to another aspect of the present invention, there is provided a connection structure for coaxial connectors for connecting at least a pair of coaxial connectors disposed in an opposing relationship to each other and displaceable in a direction perpendicular to the opposing direction thereof, wherein outer conductors of the coaxial connectors are electrically connected to each other by an outer conductor connection terminal whose opposite end portions slidably contact for angular displacement with the outer conductors, and central conductors of the coaxial connectors are electrically connected to each other by a central conductor connection terminal whose opposite end portions slidably contact for angular displacement with central conductors of the opposing coaxial connectors.

In the adapter and the connection structure for coaxial connectors of the present invention, the outer conductors and the central conductors of the coaxial connectors opposing to each other are electrically connected to each other by the outer outer conductor connection terminal and the central conductor connection terminal, respectively. Here, since the outer conductor connection terminal and the central conductor connection terminal slidably contact for angular displacement with the outer conductors and the central conductors of the opposing coaxial connectors, respectively, if the relative positions of the opposing coaxial connectors are displaced in a direction perpendicular to the opposing direction thereof, then also the outer conductor connection terminal and the central conductor connection terminal are angularly displaced by the displacement. Consequently, the coaxial connectors are kept in a condition wherein they are connected to each other by means of the outer conductor connection terminal and the central conductor connection terminal.

The structure of the outer conductor connection terminal and the central conductor connection terminal, that is, the adapter, is simplified where each of the outer conductor connection terminal and the central conductor connection terminal is a member in the form of a pipe, and the central conductor connection terminal is disposed in a coaxial relationship with the outer conductor connection terminal in a hollow of the outer conductor connection terminal. Particularly in this instance, preferably an insulating member is interposed between the outer conductor connection terminal and the central conductor connection terminal in order to prevent otherwise possible contact between them.

DETAILED DESCRIPTION OF THE PREFERRED EMBODIMENT

An embodiment of the present invention is described below with reference to the drawings.

Figure 1:
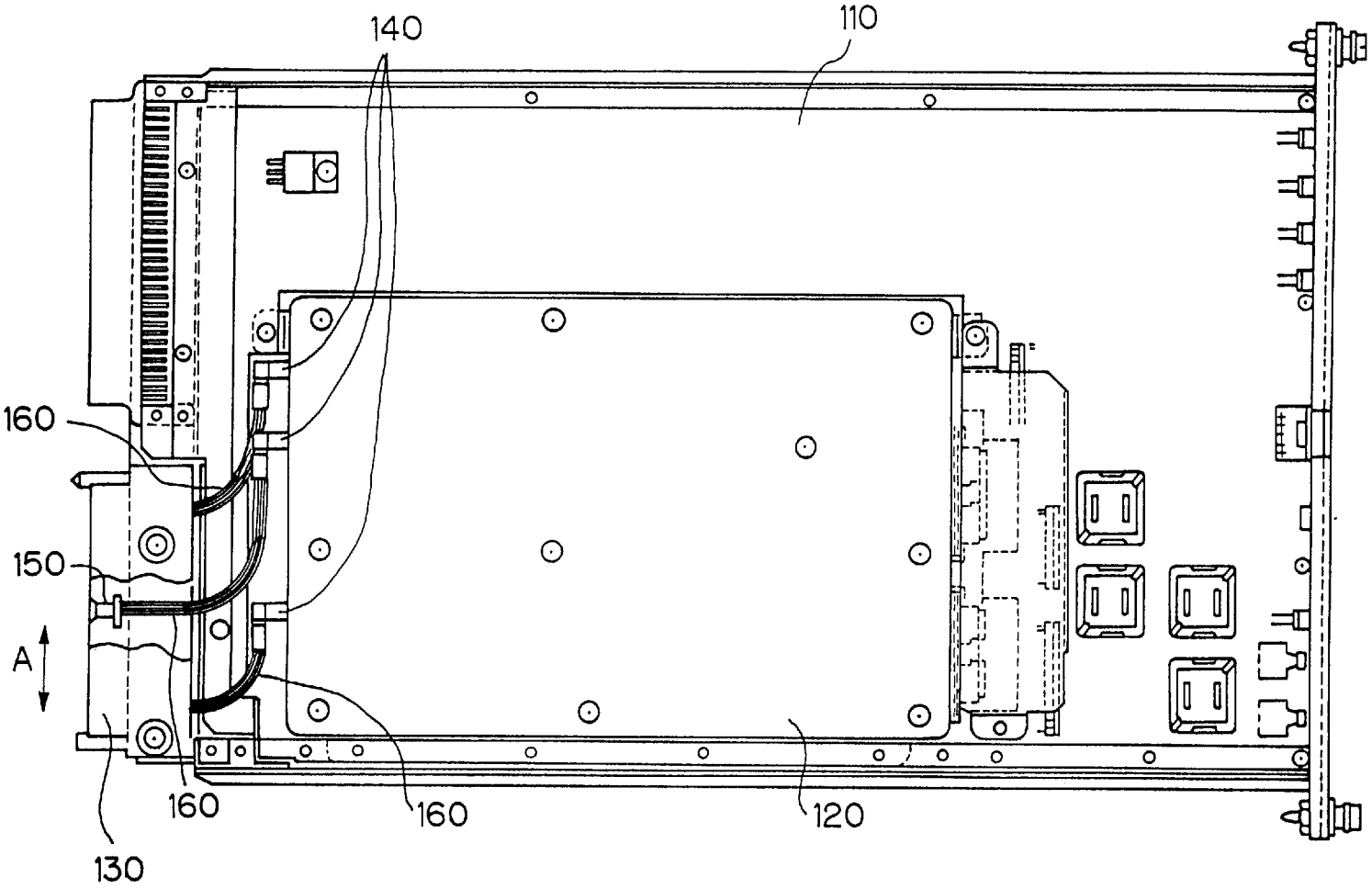
Fig. 1 (Prior Art)
FIG. 1 is a schematic view showing a conventional connection structure for coaxial connectors.
Figure 2:
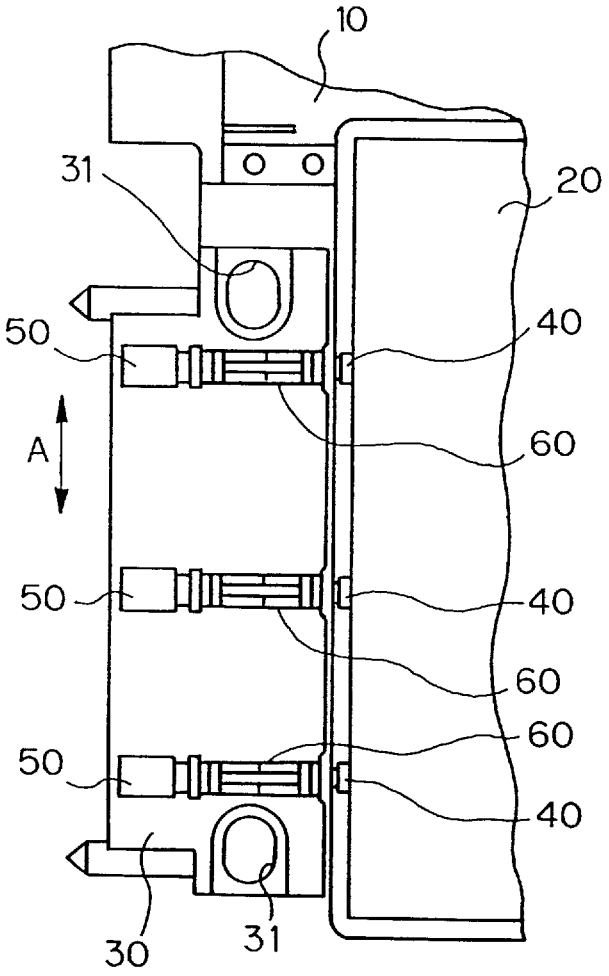
FIG. 2 is a schematic view showing an embodiment of a connection structure for coaxial connectors of the present invention.

FIG. 2 is a schematic view showing an embodiment of a connection structure for coaxial connectors of the present invention. Referring to FIG. 2, a transmitter-receiver board 10 which is mounted on a communication apparatus (not shown) includes a transmitter-receiver 20 including a case in which a transmitter-receiver circuit in the form of a unit is accommodated, and a coaxial connector housing 30. The coaxial connector housing 30 has a pair of mounting holes 31 provided at the opposite end portions thereof for mounting the coaxial connector housing 30 on the transmitter-receiver board 10 by means of screws. The coaxial connector housing 30 is mounted for movement in the direction of an arrow A on the transmitter-receiver board 10. To this end, the mounting holes 31 are formed as elongated holes.

A plurality of coaxial connectors 40 are provided in parallel to each other at an end of the transmitter-receiver 20. Also in the coaxial connector housing 30, a plurality of coaxial connectors 50 are provided at positions opposing to the coaxial connectors 40 of the transmitter-receiver 20. The coaxial connectors 40 of the transmitter-receiver 20 and the coaxial connectors 50 of the coaxial connector housing 30 are individually connected to each other by means of adapters 60.

Figure 3:
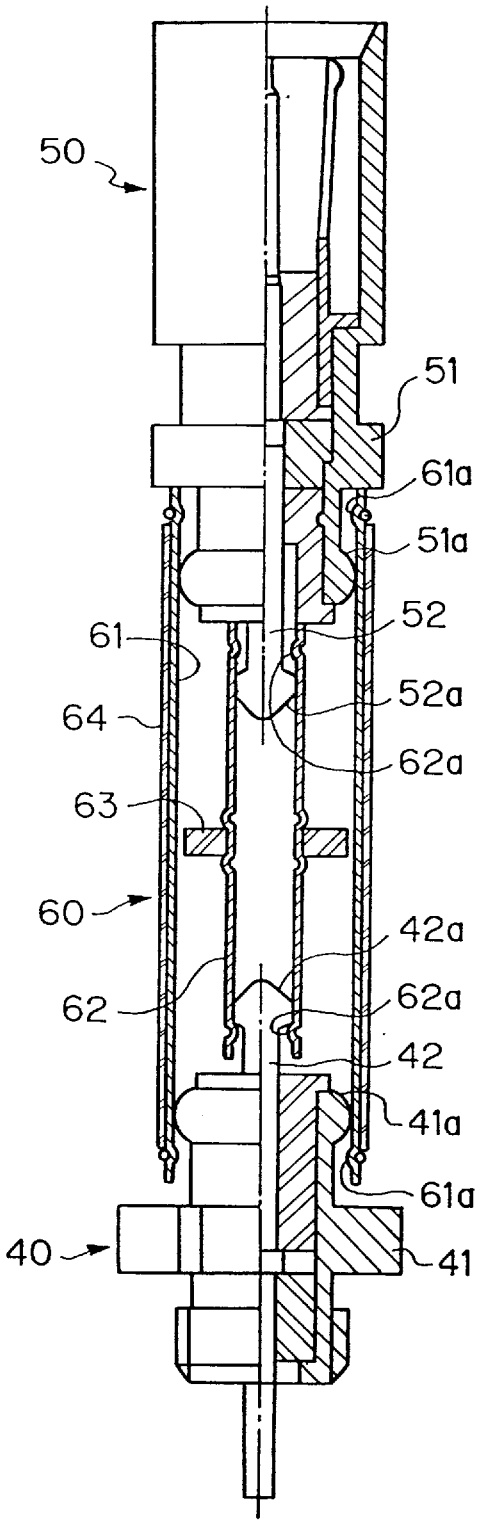
FIG. 3 is a sectional view showing an adapter shown in FIG. 2 in a condition wherein coaxial connectors are connected to each other.

Here, the structure of the adapters 60 is described with reference to FIG. 3. As shown in FIG. 3, each of the adapters 60 includes an outer conductor connection terminal 61 for electrically connecting outer conductors 41 and 51 of the coaxial connectors 40 and 50 to each other, a central conductor connection terminal 62 for electrically connecting central conductors 42 and 52 of the coaxial connectors 40 and 50 to each other, and a support member 63 interposed between the outer conductor connection terminal 61 and the central conductor connection terminal 62.

The outer conductor connection terminal 61 is a member in the form of a pipe made of a metal, and end portions of the outer conductors 41 and 51 of the coaxial connectors 40 and 50 are fitted with the opposite end portions of the outer conductor connection terminal 61. The central conductor connection terminal 62 is a member in the form of a pipe made of a metal and disposed in a hollow of the outer conductor connection terminal 61, and end portions of the central conductors 42 and 52 of the coaxial connectors 40 and 50 are fitted with the opposite end portions of the central conductor connection terminal 62. The support member 63 is a member in the form of a ring made of an insulator, and can be fitted with the hollow of the outer conductor connection terminal 61. The support member 63 is secured to an outer periphery of the central conductor connection terminal 62.

By inserting the central conductor connection terminal 62 into the outer conductor connection terminal 61 while the support member 63 is secured to the central conductor connection terminal 62, the central conductor connection terminal 62 is held coaxially with the outer conductor connection terminal 61 in an electrically isolated relationship from the outer conductor connection terminal 61. Further, an insulating coating 64 is provided on an outer periphery of the outer conductor connection terminal 61. Otherwise possible short-circuiting of the outer conductor connection terminal 61 with the other members is prevented by the coating 64.

Meanwhile, formed at end portions of the outer conductors 41 and 51 of the coaxial connectors 40 and 50 are spherical slip faces 41*a* and 51*a* which contact for angular displacement with the inner periphery of the outer conductor connection terminal 61 when they are fitted in the outer conductor connection terminal 61, respectively Formed also at end portions of the outer conductors 41 and 51 of the coaxial connectors 40 and 50 are spherical slip faces 42*a* and 52*a* which contact for angular displacement with the inner periphery of the central conductor connection terminal 62 when they are fitted with the central conductor connection terminal 62, respectively. Further, in order to prevent the coaxial connectors 40 and 50 from being pulled off inadvertently from the adapter 60, projections 61*a* and 62*a* protruding inwardly are formed over the full circumferences at the opposite end portions of the inner periphery of the outer conductor connection terminal 61 and the central conductor connection terminal 62, respectively.

A procedure of connecting the coaxial connectors 40 and 50 to each other using the adapter 60 described above is described below with reference to FIGS. 4(*a*) to 4(*c*).

Figure 4A:
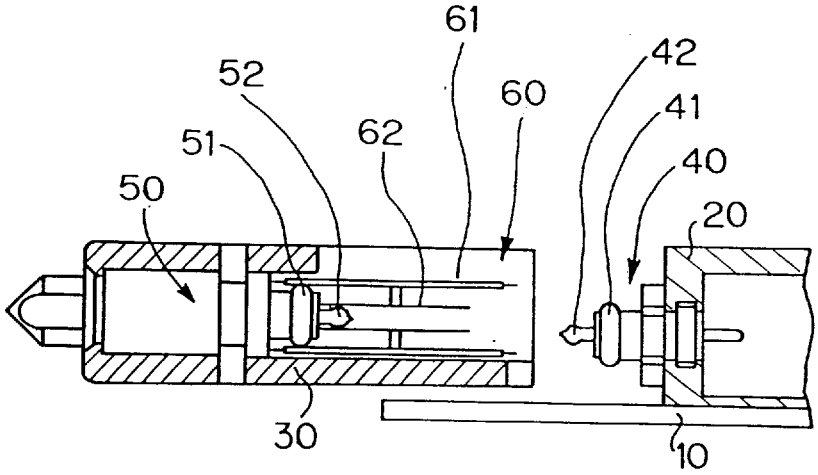
FIGS. 4(*a*) to 4(*c*) are sectional views illustrating a connection procedure of the connection structure for coaxial connectors shown in FIG. 2.
Figure 4B:
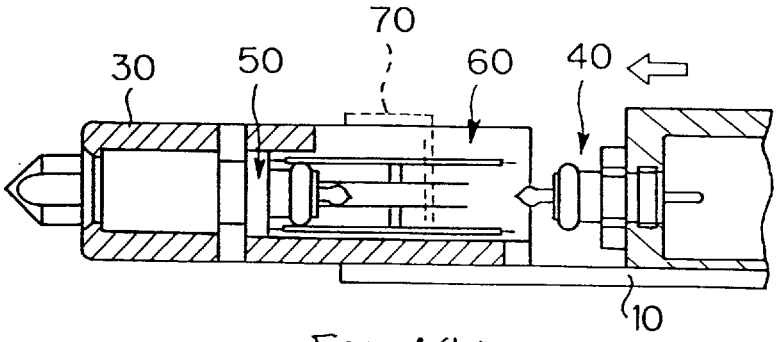
Figure 4C:
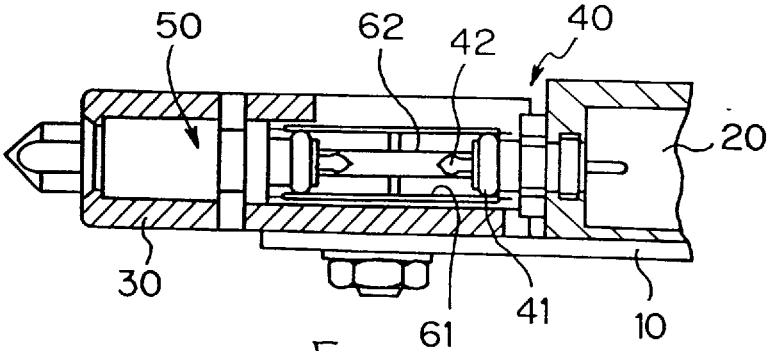

First, an end portion of the central conductor connection terminal 62 is fitted with the central conductor 52 of a coaxial connector 50 of the coaxial connector housing 30 and an end portion of the outer conductor connection terminal 61 is fitted into the outer conductor 51 as shown in FIG. 4(*a*). In this instance, the coaxial connector housing 30 is in a separate condition from the transmitter-receiver board 10, and is connected to the communication apparatus by means of the coaxial connector 50. Although the central conductor connection terminal 62 and the outer conductor connection terminal 61 may be fitted in any order, the operation is simpler where the central conductor connection terminal 62 is fitted first.

Then, the transmitter-receiver board 10 is moved in the direction indicated by an arrow as shown in FIG. 4(*b*) until the central conductor 42 of a coaxial connector 40 of the transmitter-receiver 20 is fitted with the other end portion of the central conductor connection terminal 62 while the outer conductor 41 is fitted into the other end portion of the outer conductor connection terminal 61 as shown in FIG. 4(*c*). Connection of the coaxial connectors 40 and 50 to each other is completed thereby.

Here, since the adapter 60 is mounted for angular displacement with respect of the coaxial connector 50 of the coaxial connector housing 30, when the coaxial connector 40 of the transmitter-receiver 20 is fitted with the adapter 60, the center axis of the adapter 60 is not necessarily aligned with the center axis of the coaxial connector 40.

Accordingly, fitting of the coaxial connector 40 of the transmitter-receiver 20 with the adapter 60 must be performed while the other end portion of the adapter 60 is positioned with respect to the coaxial connector 40. This does not make a serious problem where the number of coaxial connectors 40 to be connected is small, but as the number increases, the connection operation becomes complicated.

Figure 5:
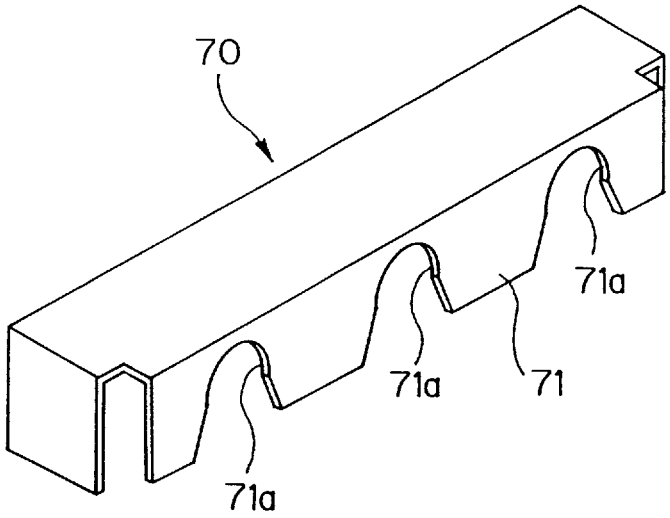
FIG. 5 is a perspective view of a positioning jig which is used to restrict the position of the adapter when the coaxial connectors are connected to each other.

Thus, in order to make it possible to perform the connection operation readily, such a positioning jig 70 as shown in FIG. 5 is preferably used. The positioning jig 70 has a front suspending wall 71 on which a plurality of recesses 71*a* into which the adapter 60 is to be fitted are formed. The recesses 71*a* are formed in a pitch equal to the pitch in which the coaxial connectors 40 and 50 are arranged. Such a positioning jig 70 as described above is placed on the coaxial connector housing 30 as indicated by a broken line in FIG. 4(*b*) to restrict the positions of the adapter 60 by means of the recesses 71*a*. Consequently, the adapters 60 are arranged in parallel to each other. Accordingly, connection of the coaxial connectors 40 of the transmitter-receiver 20 can be performed simply and at the same time.

Figure 6:
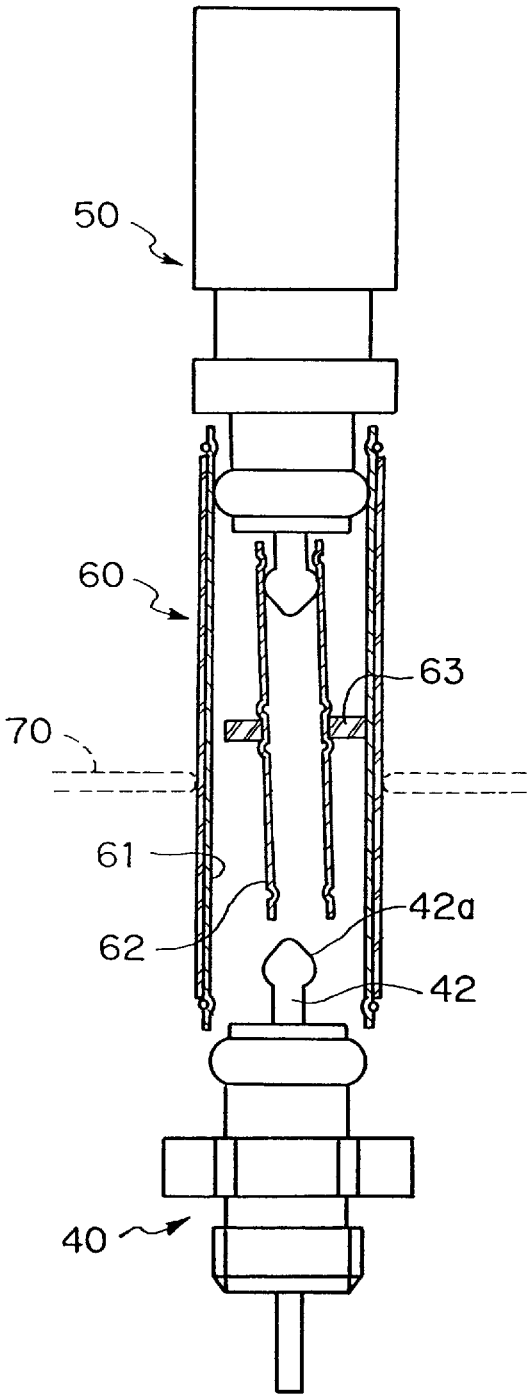
FIG. 6 is a sectional view of the adapter showing a condition wherein a central conductor connection terminal is inclined with respect to an outer conductor connection terminal.

It is to be noted that, even if the positions of the adapter 60 are restricted by the positioning jig 70, the elements that is actually restricted is the outer conductor connection terminal 61 as seen in FIG. 6. Accordingly, where a large gap is present between the inner periphery of the central conductor connection terminal 62 and the support member 63, the central conductor connection terminal 62 may possibly be inclined with respect to the outer conductor connection terminal 61. If the central conductor connection terminal 62 is inclined, then the position of the central conductor 42 of the coaxial connector 40 of the transmitter-receiver 20 and the position of the central conductor connection terminal 62 are brought out of alignment, and it becomes difficult to fit the central conductor 42 with the support member 63. In the present embodiment, however, since the end portion of the central conductor 42 is formed as the spherical slip face 42*a*, even if the position of the central conductor connection terminal 62 is displaced, the central conductor 42 can be fitted with certainty with the central conductor connection terminal 62.

After connection between the coaxial connectors 40 and 50 is completed in such a manner as described above, the coaxial connector housing 30 is mounted onto the transmitter-receiver board 10 as shown in FIG. 4(*c*), and then, the transmitter-receiver board 10 is secured to the communication apparatus.

Figure 7:
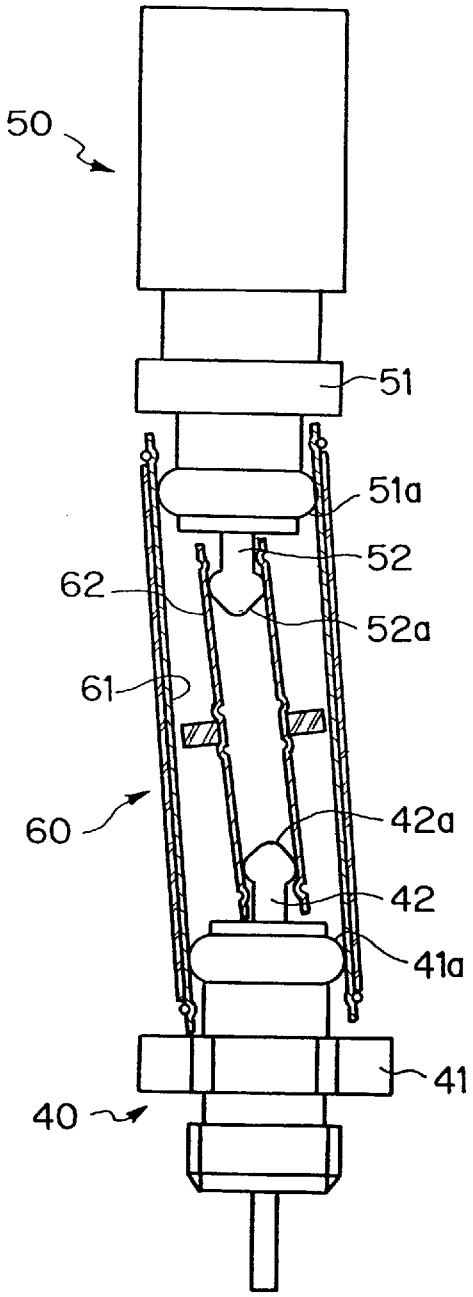
FIG. 7 is a view showing a condition wherein the relative positions of the opposing coaxial connectors in FIG. 3 are displaced from each other.

When the transmitter-receiver board 10 is secured to the communication apparatus, the relative positions between the coaxial connector housing 30 and the transmitter-receiver 20 may possibly be displaced in the direction indicated by an arrow A in FIG. 2. Even if the relative positions of them are displaced, the outer conductor connection terminal 61 and the central conductor connection terminal 62 are angularly displaced with respect to the outer conductors 41, 51 and the central conductors 42, 52 of the coaxial connectors 40, 50, respectively, as shown in FIG. 7.

Consequently, the adapter 60 is inclined in response to the displacement between the positions of the coaxial connectors 40 and 50, and the outer conductors 41 and 51 and the outer conductor connection terminal 61, and the central conductors 42 and 52 and the central conductor connection terminal 62, keep the electrically connected conditions thereof, respectively. Accordingly, no coaxial cable is required for connection between the coaxial connectors 40 and 50, and the space between the coaxial connector housing 30 and the transmitter-receiver 20 can be minimized and the size of the transmitter-receiver board 10 can be reduced as much.

In the embodiment described above, the construction wherein the support member 63 is secured only to the central conductor connection terminal 62 while the central conductor connection terminal 62 is removably mounted on the outer conductor connection terminal 61 is described. However, the support member 63 may be securely mounted on the outer conductor connection terminal 61 and the central conductor connection terminal 62 so that the outer conductor connection terminal 61 and the central conductor connection terminal 62 may serve as a unitary member.

As described above, according to the present invention, since outer conductors and central conductors of coaxial connectors are connected to each other by an outer conductor connection terminal and a central conductor connection terminal which slidably contact for angular displacement with them, respectively, even if the opposing positions of the coaxial connectors are displaced from each other, the coaxial connectors can be connected to each other without using a coaxial cable. As a result, the space between the opposing coaxial connectors is minimized, and the connection structure for coaxial connectors which has a comparatively small size can be provided.

What is claimed is:

1. An adapter for connecting at least a pair of coaxial connectors disposed in an opposing relationship to each other and displaceable in a direction perpendicular to the opposing direction thereof, comprising:

an outer conductor connection terminal having cylindrical opposite end portions that are adapted to receive therein and slidably contact spherical slip faces of outer conductors of the opposing coaxial connectors for angular displacement with respect to the opposing direction;

a central conductor connection terminal having cylindrical opposite end portions that are adapted to receive and slidably contact spherical slip faces of central conductors of the opposing coaxial connectors for angular displacement with respect to the opposing direction; and a ring-shaped support member secured to the central conductor connection terminal, wherein the ring-shaped support member is not connected to the outer conductor connection terminal.

2. The adapter as recited in claim 1, wherein the ring-shaped support member comprises an insulator.

3. The adapter as recited in claim 1, wherein the outer conductor connection terminal comprises a member in the form of a pipe.

4. The adapter as recited in claim 1, wherein the central conductor connection terminal comprises a member in the form of a pipe.

5. An adapter for connecting at least a pair of male coaxial connectors disposed in an opposing relationship to each other and displaceable in a direction perpendicular to the opposing direction thereof, comprising:

an outer conductor connection terminal having cylindrical opposite end portions that are adapted to receive and slidably contact male ends of outer conductors of the opposing coaxial connectors for angular displacement with respect to the opposing direction;

a central conductor connection terminal having cylindrical opposite end portions that are adapted to receive and slidably contact male ends of central conductors of the opposing coaxial connectors for angular displacement with respect to the opposing direction; and a ring-shaped support member secured to the central conductor connection terminal.

6. The adapter as recited in claim 5, wherein the ring-shaped support member comprises an insulator.

7. The adapter as recited in claim 5, wherein the ring-shaped support member is not connected to the outer conductor connection terminal.

8. The adapter as recited in claim 5, wherein the outer conductor connection terminal comprises a member in the form of a pipe.

9. The adapter as recited in claim 5, wherein the central conductor connection terminal comprises a member in the form of a pipe.

10. The adapter as recited in claim 5, wherein the male ends of the outer conductors comprise spherical slip faces.

11. The adapter as recited in claim 5, wherein the male ends of the central conductors comprise spherical slip faces.

12. A connection structure comprising:

at least a pair of coaxial connectors disposed in an opposing relationship to each other, each coaxial connector having an outer conductor with a spherical slip face and a central conductor with a spherical slip face; and an adapter including an outer conductor connection terminal, a central conductor connection terminal, and a ring-shaped support member secured to the central conductor connection terminal, the outer conductor connection terminal having cylindrical opposite end portions that are adapted to receive therein and slidably contact the spherical slip faces of the outer conductors of the opposing coaxial connectors, the central conductor connection terminal having cylindrical opposite end portions that are adapted to receive and slidably contact the spherical slip faces of the central conductors of the opposing coaxial connectors, wherein the ring-shaped support member is not connected to the outer conductor connection terminal.

13. The connection structure as recited in claim 12, wherein the ring-shaped support member comprises an insulator.

14. The connection structure as recited in claim 12, wherein the outer conductor connection terminal comprises a member in the form of a pipe.

15. The connection structure as recited in claim 12, wherein the central conductor connection terminal comprises a member in the form of a pipe.

* * * * *